US006386602B1

(12) United States Patent
Lan

(10) Patent No.: US 6,386,602 B1
(45) Date of Patent: May 14, 2002

(54) LEVER HANDLE STRUCTURE FOR LOCK

(75) Inventor: Huang Mu Lan, Kaohsiung Hsien (TW)

(73) Assignee: Tawain Fu Hsing Industrial Co., Ltd., Kaohsiung Hsien (TW)

( * ) Notice: Subject to any disclaimer, the term of this patent is extended or adjusted under 35 U.S.C. 154(b) by 57 days.

(21) Appl. No.: 09/696,288

(22) Filed: Oct. 26, 2000

(51) Int. Cl.[7] ..... E05B 3/00

(52) U.S. Cl. ..... 292/336.3; 292/348; 292/357; 292/DIG. 61; 292/DIG. 53

(58) Field of Search ..... 292/336.3, 348, 292/357, DIG. 61, DIG. 53

(56) References Cited

U.S. PATENT DOCUMENTS

| | | | | | |
|---|---|---|---|---|---|
| 4,832,385 | A | * | 5/1989 | Llort | 292/144 |
| 5,265,924 | A | * | 11/1993 | Kim | 292/336.3 |
| 5,390,517 | A | * | 2/1995 | Yamada | 70/210 |
| 5,441,318 | A | * | 8/1995 | Ghostley | 292/336.3 |
| 5,481,890 | A | * | 1/1996 | Millman | 292/336.3 |
| 5,727,406 | A | * | 3/1998 | Banducci | 292/336.3 |
| 5,761,936 | A | * | 6/1998 | Katayama | 292/336.3 |
| 5,941,108 | A | * | 8/1999 | Shen | 292/336.3 |
| 5,992,189 | A | * | 11/1999 | McCaa | 464/135 |
| 6,085,561 | A | * | 7/2000 | Yao | 70/149 |
| 6,101,856 | A | * | 8/2000 | Pelletier et al. | 70/472 |
| 6,105,407 | A | * | 8/2000 | Yao | 70/223 |
| 6,216,500 | B1 | * | 4/2001 | Kang | 292/336.3 |
| 6,223,567 | B1 | * | 5/2001 | Fadul | 70/149 |
| 6,279,360 | B1 | * | 8/2001 | Shen | 292/336.3 |

FOREIGN PATENT DOCUMENTS

| | | |
|---|---|---|
| TW | 398550 | 7/1989 |

* cited by examiner

*Primary Examiner*—Anthony Knight
*Assistant Examiner*—Matthew E. Rodgers
(74) *Attorney, Agent, or Firm*—Bacon & Thomas, PLLC

(57) ABSTRACT

A lever handle structure includes a fixed disk defining an axial hole and having a first side provided with a positioning. catch piece, a driving axial tube rotatably mounted in the axial hole of the fixed disk and having a first end defining a guide slot and an annular groove, a lever handle secured on the driving axial tube for rotating it, a positioning catch ring having an inner wall provided with two lock blocks each secured in the guide slot of the driving axial tube and an outer wall defining an arcuate limit recess receiving the positioning catch piece and having two distal ends each formed with a stop wall for limiting rotation of the driving axial tube, an elastic member secured on the driving axial tube and rested on the positioning catch ring, an actuating ring secured on the driving axial tube and rested on the elastic member, and a positioning member secured in the annular groove of the driving axial tube for preventing detachment of the actuating ring.

5 Claims, 3 Drawing Sheets

LEVER HANDLE STRUCTURE FOR LOCK

BACKGROUND OF THE INVENTION

1. Field of the Invention

The present invention relates to a lever handle structure for a lock.

2. Description of the Related Art

A conventional lever handle structure of a lock in accordance with the prior art comprises a lever handle for rotating-a driving axial tube which drives a drive wheel of a latch bolt to rotate so that the latch tongue of the latch bolt is retracted inward, thereby opening the door plate. However, when the angle of rotation of the lever handle is too great, the latch bolt is subjected to the force directly, thereby breaking the latch bolt.

Taiwan Utility Model Publication No. 398550, entitled "Improvement of an Anti-Theft lock structure", discloses a locking plate 14 mounted on a square shaft of a handle 13. When the handle 13 is rotated, the wall of the locking plate 14 is rested on the post of the faceplate of the lock so that the handle 13 cannot be further rotated, thereby controlling the rotational angle of the handle 13. However, the locking plate 14 is not positioned so that it can be moved on the square shaft of the handle 13. When the locking plate 14 is moved on the square shaft of the handle 13 to an excessive extent, the locking plate 14 cannot be rested on the post of the faceplate of the lock so that the rotational angle of the handle 13 cannot be controlled efficiently. In addition, the driving axial tube rotated by the handle will easily deviate the direction of rotation or sway in an unstable manner during long-term utilization.

SUMMARY OF THE INVENTION

The primary objective of the present invention is to provide a lever handle structure comprising:

a fixed disk having a first side and a second side, the fixed disk defining two positioning holes and an axial hole, the first side of the fixed disk provided with two spaced support members and: a positioning catch piece;

a driving axial tube rotatably mounted in the axial hole of the fixed disk and provided with an annular shoulder rested on the second side of the fixed disk, the driving axial tube having a first end protruding outward from the first side of the fixed disk and defining a guide slot and an annular groove;

a lever handle secured on a second end of the driving axial tube for rotating the driving axial tube;

a positioning catch ring secured on the first end of the driving axial tube to rotate therewith and rested on the first side of the fixed disk, the positioning catch ring having an inner wall provided with two opposite lock blocks each secured in the guide slot of the driving axial tube and having an outer wall defining an arcuate limit recess for slidably receiving the positioning catch piece of the fixed disk therein, the limit recess of the positioning catch ring having two distal ends each formed with a stop wall detachably rested on the positioning catch piece of the fixed disk for limiting rotation of the driving axial tube;

an elastic member secured on the first end of the driving axial tube and rested on the positioning catch ring, the elastic member having two ends each rested on the support member of the fixed disk;

an actuating ring secured on the first end of the driving axial tube to rotate therewith and rested on the elastic member; and a positioning member secured in the annular groove of the driving axial tube to rotate therewith and rested on the actuating ring for preventing detachment of the actuating ring.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
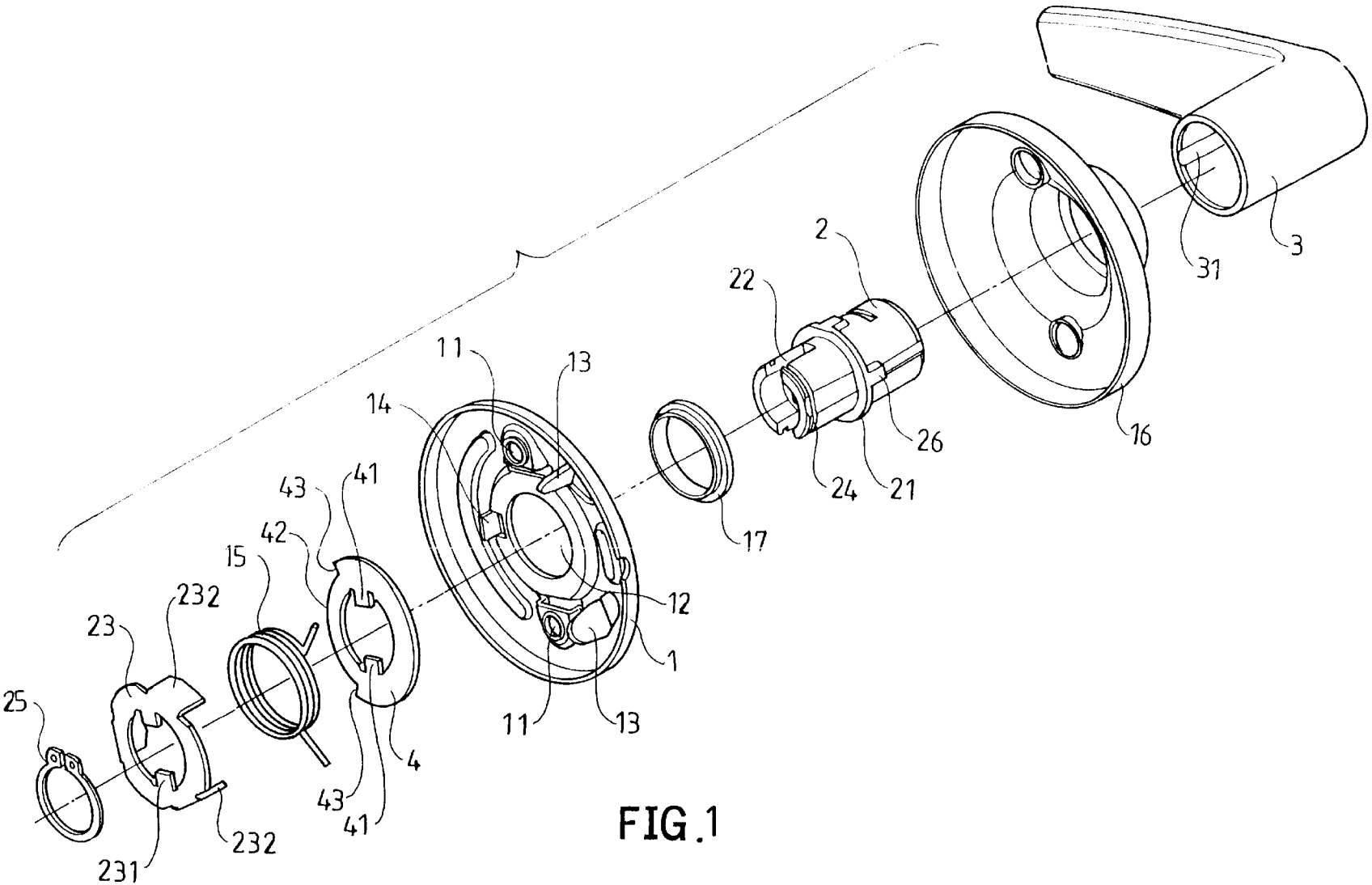
FIG. 1 is an exploded perspective view of a lever handle structure for a lock in according the present invention.
Figure 2:
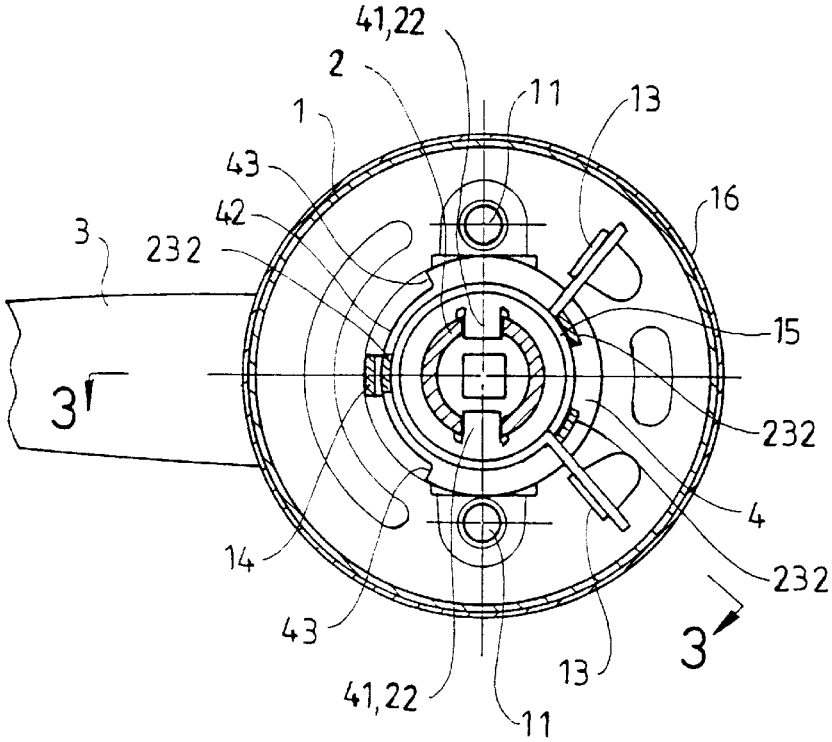
FIG. 2 is a front plan cross-sectional assembly view of the lever handle structure for a lock as shown in FIG. 1.
Figure 3:
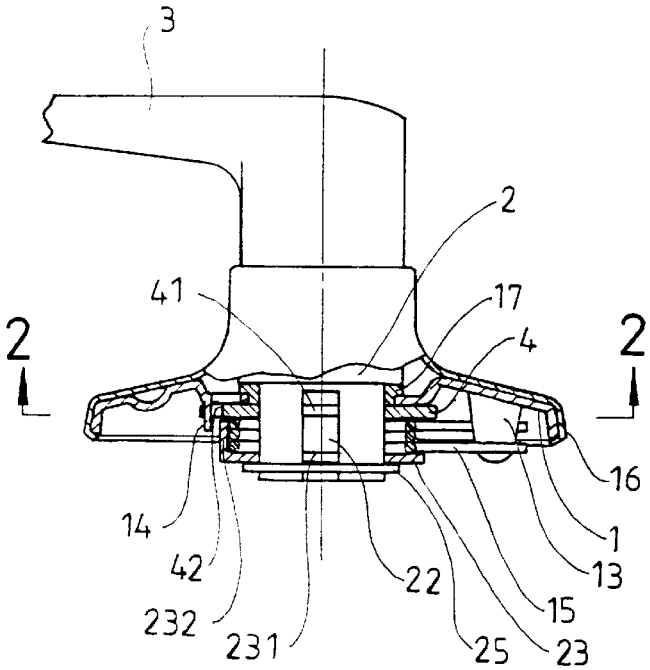
FIG. 3 is a top plan cross-sectional view of the lever handle structure for a lock along the line 3—3 as shown in FIG. 2.

Referring to FIGS. 1–3, a lever handle structure for a lock in accordance with the present invention generally comprises a fixed disk 1, a driving axial tube 2, a lever handle 3, and a positioning catch ring 4.

The fixed disk 1 defines two positioning holes 11 for fixing the fixed disk 1 to a door plate (not shown) by means of a locking member (not shown). The fixed disk 1 also defines an axial hole 12 for allowing rotation of the driving axial tube 2. The fixed disk 1 has a first side and a second side, wherein the first side of the fixed disk 1 is provided with two spaced apart support members 13 and a positioning catch piece 14. Preferably, a decorative cover 16 is mounted on the second side of the fixed disk I for enhancing the aesthetic quality of the fixed disk 1.

The driving axial tube 2 is rotatably mounted in the axial hole 12 of the fixed disk 1 and is provided with an annular enlarged shoulder 21 rested on the second side of the fixed disk 1. The driving axial tube 2 has a first end protruding outward from the first side of the fixed disk 1 and defining a guide slot 22 and an annular groove 24. Preferably, a washer 17 is mounted between the axial hole 12 of the fixed disk 1 and the driving axial tube 2 for decreasing the friction therebetween.

The driving axial tube 2 has an inner wall defining a square hole (not shown) for allowing passage of a drive shaft (not shown) which is used to drive a drive wheel (not shown) of a latch bolt (not shown) to rotate.

The lever handle 3 is secured on a second end of the driving axial tube 2 for rotating the driving axial tube 2. Preferably, the driving axial tube 2 has an outer wall provided with a lug 26, and the lever handle 3 has an inner wall defining a guide track 31 for receiving the lug 26 of the driving axial tube 2 therein so that the driving axial tube 2 is rotated with the lever handle 3.

The positioning catch ring 4 is secured or bonded on the first end of the driving axial tube 2 to rotate therewith and. is rested on the first side of the fixed disk 1. The positioning catch ring 4 has an inner wall provided with two opposite lock blocks 41 each secured in the guide slot 22 of the driving axial tube 2 so that the positioning catch ring 4 is rotated with the driving axial tube 2 and has an outer wall defining an arcuate limit recess 42 for slidably receiving the positioning catch piece 14 of the fixed disk 1 therein. The limit recess 42 of the positioning catch ring 4 has two distal ends each formed with a stop wall 43 detachably rested on the positioning catch piece 14 of the fixed disk 1 for limiting further rotation of the driving axial tube 2.

An elastic member 15, such as a torsion spring, is secured on the first end of the driving axial tube 2 and is rested on the positioning catch ring 4. The elastic member 15 has two ends or legs each rested on the support member 13 of the fixed disk 1. When the driving axial tube 2 is rotated, one of the two legs of the elastic member 15 is driven to rotate therewith, thereby providing a restoring rotational force to the driving axial tube 2.

An actuating ring 23 is secured on the first end of the driving axial tube 2 to rotate therewith and is rested on the elastic member 15. The actuating ring 23 has an inner wall provided with two opposite lock blocks 231 each secured in the guide slot 22 of the driving axial tube 2 so that the actuating ring 23 is rotated with the driving axial tube 2. The actuating ring has an outer wall formed with two legs 232 each rested on the leg of the elastic member 15.

A positioning member 25 such a C-shaped snap ring is secured in the annular groove 24 of the driving axial tube 2 to rotate therewith and is rested on the actuating ring 23 for preventing detachment of the positioning catch ring 4, the elastic member 15, and the actuating ring 23.

In operation, referring to FIGS. 1–4, the positioning catch piece 14 of the fixed disk 1 is initially located between the two stop walls 43 of the limit recess 42 of the positioning catch ring 4 as shown in Fig., 2 so that the driving axial tube 2 can be rotated by the lever handle 3 to rotate the drive shaft (not shown) which drives the drive wheel (not shown) of the latch bolt (not shown) to rotate, thereby opening the door plate.

One of the two legs 232 of the actuating ring 23 is urged on the respective leg of the elastic member 15 during rotation of the driving axial tube 2, thereby in turn deforming the elastic member 15.

The positioning catch ring 4 is limited in place by the positioning member 25 and is pressed by the actuating ring. 23 and the elastic member 15 so that the positioning catch ring 4 is tightly rested on the first side of the fixed disk 1. At the same time, the annular shoulder 21 of the driving axial tube 2 is rested on the washer 17 which is tightly rested on the second side of the fixed disk 1. Accordingly, the driving axial tube 2 can be rotated rigidly, and will not deviate the direction of rotation or sway in an unstable manner during long-term utilization.

Figure 4:
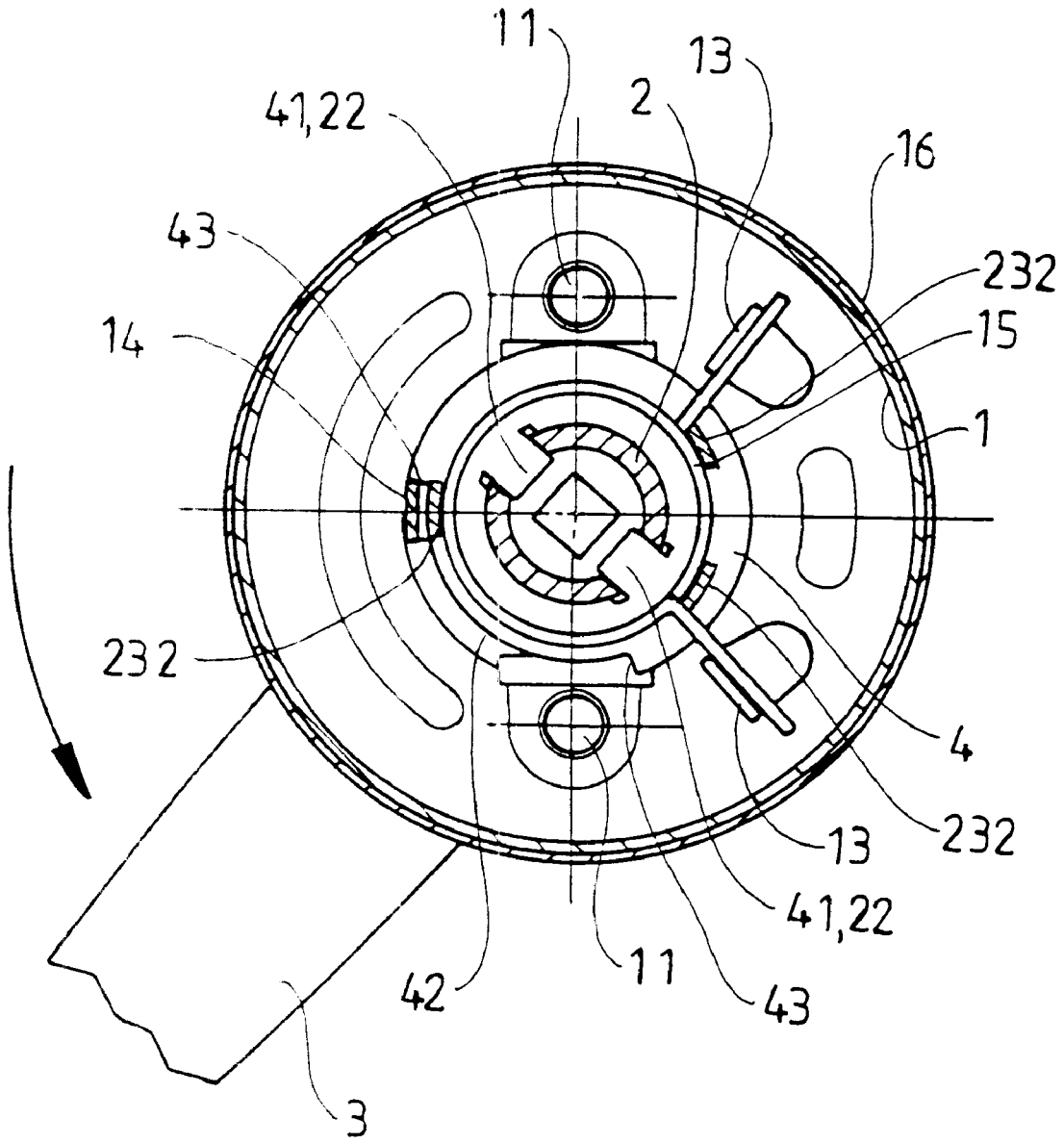
FIG. 4 is an operational view of the lever handle structure for a lock as shown in FIG. 2.

When the positioning catch ring 4 is rotated with the driving axial tube 2 from the position as shown in FIG. 2 to the position as shown in FIG. 4, the positioning catch piece 14 of the fixed disk 1 is rested on one of the two stop walls 43 of the limit recess 42 of the positioning catch;ring 4, thereby limiting the further rotation of the driving axial tube 2 so that no further rotational force is exerted on the latch bolt while the driving axial tube 2 and the lever handle 3 can be rigidly rotated in a limited angle.

Accordingly, by such an arrangement of the present invention, the driving axial tube 2 and the lever handle 3 are limited to rotate in a determined angle so that no further rotational force is exerted on the latch bolt, thereby preventing breaking the latch bolt.

In addition, the driving axial tube 2 can be rotated rigidly along the direction of rotation, and will not deviate the central line of rotation or sway in an unstable manner during long-term utilization.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A lever handle structure comprising:

a fixed disk (1) having a first side and a second side, said fixed disk (1) defining two positioning holes (11) and an axial hole (12), said first side of said fixed disk (1) provided with two spaced support members (13) and a positioning catch piece (14);

a driving axial tube (2) rotatably mounted in said axial hole (12) of said fixed disk (1) and provided with an annular shoulder (21) rested on said second side of said fixed disk (1), said driving axial tube (2) having a first end protruding outward from said first side of said fixed disk (1) and defining a guide slot (22) and an annular groove (24);

a lever handle (3) secured on a second end of said driving axial tube (2) for rotating said driving axial tube (2);

a positioning catch ring (4) secured on said first end of said driving axial tube (2) to rotate therewith and rested on said first side of said fixed disk (1), said positioning catch ring (4) having an inner wall provided with two opposite lock blocks (41) each secured in said guide slot (22) of said driving axial tube (2) and having an outer wall defining an arcuate limit recess (42) for slidably receiving said positioning catch piece (14) of said fixed disk (1) therein, said limit recess (42) of said positioning catch ring (4) having two distal ends each formed with a stop wall (43) detachably rested on said positioning catch piece (14) of said fixed disk (1) for limiting rotation of said driving axial tube (2);

an elastic member (15) secured on said first end of said driving axial tube (2) and rested on said positioning catch ring (4), said elastic member (15) having two ends each rested on said support member (13) of said fixed disk (1);

an actuating ring (23) secured on said first end of said driving axial tube (2) to rotate therewith and rested on said elastic member (15); and a positioning member (25) secured in said annular groove (24) of said driving axial tube (2) to rotate therewith and rested on said actuating ring (23) for preventing detachment of said actuating ring (23).

2. The lever handle structure for a lock as claimed in claim 1, further comprising a washer (17) mounted between said axial hole (12) of said fixed disk (1) and said driving axial tube (2).

3. The lever handle structure for a lock as claimed in claim 1, wherein said positioning catch ring (4) is bonded on said first side of said fixed disk (1).

4. The lever handle structure for a lock as claimed in claim 1, further comprising a decorative cover (16) mounted on said second side of said fixed disk (1).

5. The lever handle structure for a lock as claimed in claim 1, wherein said driving axial tube (2) has an outer wall provided with a lug (26), and said lever handle (3) has an inner wall defining a guide track (31) for receiving said lug (26) of said driving axial tube (2) therein so that said driving axial tube (2) is rotated with said lever handle (3).

* * * * *